US010227939B2

(12) United States Patent
Rayl

(10) Patent No.: US 10,227,939 B2
(45) Date of Patent: Mar. 12, 2019

(54) CYLINDER DEACTIVATION PATTERN MATCHING

(71) Applicant: GM GLOBAL TECHNOLOGY OPERATIONS LLC, Detroit, MI (US)

(72) Inventor: Allen B. Rayl, Waterford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1435 days.

(21) Appl. No.: 13/798,351

(22) Filed: Mar. 13, 2013

(65) Prior Publication Data

US 2014/0053802 A1 Feb. 27, 2014

Related U.S. Application Data

(60) Provisional application No. 61/693,005, filed on Aug. 24, 2012.

(51) Int. Cl.
*F02D 41/00* (2006.01)
*F02D 41/12* (2006.01)
(Continued)

(52) U.S. Cl.
CPC ..... *F02D 41/0087* (2013.01); *F02D 13/06* (2013.01); *F02D 17/023* (2013.01);
(Continued)

(58) Field of Classification Search
CPC ..... F02D 41/0087; F02D 41/0062; F02D 41/0225; F02D 41/18
(Continued)

(56) References Cited

U.S. PATENT DOCUMENTS 3,596,640 A 8/1971 Bloomfield
4,129,034 A 12/1978 Niles et al.
(Continued)

FOREIGN PATENT DOCUMENTS

CN 1573916 A 2/2005
CN 1888407 A 1/2007
(Continued)

OTHER PUBLICATIONS

U.S. Appl. No. 13/798,351, filed Mar. 13, 2013, Rayl.
(Continued)

*Primary Examiner* — Mahmoud Gimie
*Assistant Examiner* — Josh Campbell

(57) ABSTRACT

A cylinder control module: selects one of N predetermined cylinder activation/deactivation patterns as a desired cylinder activation/deactivation pattern for cylinders of an engine, wherein N is an integer greater than two; and activates and deactivates opening of intake and exhaust valves of first and second ones of the cylinders that are to be activated based on the desired cylinder activation/deactivation pattern, respectively. A fuel control module provides fuel to the first ones of the cylinders and disables fueling to the second ones of the cylinders. The cylinder control module further: determines M possible ones of the N cylinder activation/deactivation patterns, wherein M is an integer greater than or equal to one; selectively compares the M possible cylinder activation/deactivation patterns with the desired cylinder activation/deactivation pattern; and selectively updates the desired cylinder activation/deactivation pattern to one of the M possible cylinder activation/deactivation patterns.

18 Claims, 4 Drawing Sheets

(51) Int. Cl.

| | |
|---|---|
| ***F02D 13/06*** | (2006.01) |
| ***F02D 17/02*** | (2006.01) |
| *F02D 41/02* | (2006.01) |
| *F02D 41/18* | (2006.01) |

(52) U.S. Cl.
CPC ..... *F02D 41/123* (2013.01); *F02D 41/0062* (2013.01); *F02D 41/0225* (2013.01); *F02D 41/18* (2013.01)

(58) Field of Classification Search
USPC ..... 123/350, 481
See application file for complete search history.

(56) References Cited

U.S. PATENT DOCUMENTS 4,172,434 A 10/1979 Coles
4,377,997 A 3/1983 Staerzl
4,434,767 A 3/1984 Kohama et al.
4,489,695 A 12/1984 Kohama et al.
4,509,488 A 4/1985 Forster et al.
4,535,744 A 8/1985 Matsumura
4,770,148 A 9/1988 Hibino et al.
4,887,216 A 12/1989 Ohnari et al.
4,974,563 A 12/1990 Ikeda et al.
4,987,888 A 1/1991 Funabashi et al.
5,042,444 A 8/1991 Hayes et al.
5,094,213 A 3/1992 Dudek et al.
5,226,513 A 7/1993 Shibayama
5,278,760 A 1/1994 Ribbens et al.
5,357,932 A 10/1994 Clinton et al.
5,374,224 A 12/1994 Huffmaster et al.
5,377,631 A * 1/1995 Schechter ..... F01L 9/02 123/198 F
5,423,208 A 6/1995 Dudek et al.
5,465,617 A 11/1995 Dudek et al.
5,540,633 A 7/1996 Yamanaka et al.
5,553,575 A 9/1996 Beck et al.
5,584,266 A 12/1996 Motose et al.
5,669,354 A 9/1997 Morris
5,692,471 A 12/1997 Zhang
5,720,257 A 2/1998 Motose et al.
5,813,383 A 9/1998 Cummings
5,884,605 A 3/1999 Nagaishi et al.
5,909,720 A 6/1999 Yamaoka et al.
5,931,140 A 8/1999 Maloney
5,934,263 A 8/1999 Russ et al.
5,941,927 A 8/1999 Ptitz
5,975,052 A 11/1999 Moyer
5,983,867 A 11/1999 Stuber et al.
6,125,812 A 10/2000 Garabedian
6,158,411 A 12/2000 Morikawa
6,244,242 B1 6/2001 Grizzle et al.
6,247,449 B1 6/2001 Persson
6,272,427 B1 8/2001 Wild et al.
6,286,366 B1 9/2001 Chen et al.
6,295,500 B1 9/2001 Cullen et al.
6,332,446 B1 12/2001 Matsumoto et al.
6,334,425 B1 1/2002 Nagatani et al.
6,355,986 B1 3/2002 Kato et al.
6,360,724 B1 * 3/2002 Suhre ..... F02D 17/02 123/481
6,363,316 B1 3/2002 Soliman et al.
6,371,075 B2 4/2002 Koch
6,385,521 B1 5/2002 Ito
6,520,140 B2 2/2003 Dreymuller et al.
6,546,912 B2 4/2003 Tuken
6,619,258 B2 9/2003 McKay et al.
6,622,548 B1 9/2003 Hernandez
6,694,806 B2 2/2004 Kumagai et al.
6,754,577 B2 6/2004 Gross et al.
6,760,656 B2 7/2004 Matthews et al.
6,850,831 B2 2/2005 Buckland et al.
6,909,961 B2 6/2005 Wild et al.
6,978,204 B2 12/2005 Surnilla et al.
6,980,902 B2 12/2005 Nakazawa
6,981,492 B2 1/2006 Barba et al.
6,983,737 B2 1/2006 Gross et al.
7,003,390 B2 2/2006 Kaga
7,024,301 B1 4/2006 Kar et al.
7,028,661 B1 4/2006 Bonne et al.
7,032,545 B2 4/2006 Lewis et al.
7,032,581 B2 4/2006 Gibson et al.
7,044,101 B1 5/2006 Duty et al.
7,063,062 B2 6/2006 Lewis et al.
7,066,121 B2 6/2006 Michelini et al.
7,066,136 B2 6/2006 Ogiso
7,069,718 B2 7/2006 Surnilla et al.
7,069,773 B2 7/2006 Stempnik et al.
7,086,386 B2 8/2006 Doering
7,100,720 B2 9/2006 Ishikawa
7,111,612 B2 9/2006 Michelini et al.
7,140,355 B2 11/2006 Michelini et al.
7,159,568 B1 1/2007 Lewis et al.
7,174,713 B2 2/2007 Nitzke et al.
7,174,879 B1 2/2007 Chol et al.
7,200,486 B2 4/2007 Tanaka et al.
7,203,588 B2 4/2007 Kaneko et al.
7,231,907 B2 6/2007 Bolander et al.
7,278,391 B1 10/2007 Wong et al.
7,292,231 B2 11/2007 Kodama et al.
7,292,931 B2 11/2007 Davis et al.
7,319,929 B1 1/2008 Davis et al.
7,363,111 B2 4/2008 Vian et al.
7,367,318 B2 5/2008 Moriya et al.
7,415,345 B2 8/2008 Wild
7,440,838 B2 10/2008 Livshiz et al.
7,464,676 B2 12/2008 Wiggins et al.
7,472,014 B1 12/2008 Albertson et al.
7,497,074 B2 3/2009 Surnilla et al.
7,499,791 B2 3/2009 You et al.
7,503,312 B2 3/2009 Surnilla et al.
7,509,201 B2 3/2009 Bolander et al.
7,577,511 B1 8/2009 Tripathi et al.
7,581,531 B2 9/2009 Schulz
7,614,384 B2 11/2009 Livshiz et al.
7,620,188 B2 11/2009 Inoue et al.
7,621,262 B2 11/2009 Zubeck
7,634,349 B2 12/2009 Senft et al.
7,685,976 B2 3/2010 Marriott
7,785,230 B2 8/2010 Gibson et al.
7,836,866 B2 * 11/2010 Luken ..... F02D 17/02 123/481
7,849,835 B2 12/2010 Tripathi et al.
7,886,715 B2 2/2011 Tripathi et al.
7,930,087 B2 4/2011 Gibson et al.
7,946,263 B2 5/2011 O'Neill et al.
7,954,474 B2 6/2011 Tripathi et al.
8,050,841 B2 11/2011 Costin et al.
8,099,224 B2 1/2012 Tripathi et al.
8,108,132 B2 1/2012 Reinke
8,131,445 B2 3/2012 Tripathi et al.
8,131,447 B2 3/2012 Tripathi et al.
8,135,410 B2 3/2012 Forte
8,145,410 B2 3/2012 Berger et al.
8,146,565 B2 4/2012 Leone et al.
8,272,367 B2 9/2012 Shikama et al.
8,473,179 B2 6/2013 Whitney et al.
8,616,181 B2 12/2013 Sahandiesfanjani et al.
8,646,430 B2 2/2014 Kinoshita
8,646,435 B2 2/2014 Dibble et al.
8,701,628 B2 4/2014 Tripathi et al.
8,706,383 B2 4/2014 Sauve et al.
8,833,058 B2 9/2014 Ervin et al.
8,833,345 B2 9/2014 Pochner et al.
8,869,773 B2 10/2014 Tripathi et al.
8,979,708 B2 3/2015 Burtch
9,140,622 B2 9/2015 Beikmann
9,222,427 B2 12/2015 Matthews et al.
2001/0007964 A1 7/2001 Poljansek et al.
2002/0039950 A1 4/2002 Graf et al.
2002/0156568 A1 10/2002 Knott et al.
2002/0162540 A1 * 11/2002 Matthews ..... F02D 17/02 123/481

(56) References Cited

U.S. PATENT DOCUMENTS

2002/0189574 A1 12/2002 Kim
2003/0116130 A1 6/2003 Kisaka et al.
2003/0123467 A1 7/2003 Du et al.
2003/0131820 A1 7/2003 Mckay et al.
2003/0172900 A1 9/2003 Boyer et al.
2004/0007211 A1 1/2004 Kobayashi
2004/0034460 A1 2/2004 Folkerts et al.
2004/0069290 A1 4/2004 Bucktron et al.
2004/0122584 A1 6/2004 Muto et al.
2004/0129249 A1 7/2004 Kondo
2004/0206072 A1* 10/2004 Surnilla ..... F02D 17/02 123/481
2004/0258251 A1 12/2004 Inoue et al.
2005/0016492 A1 1/2005 Matthews
2005/0056250 A1 3/2005 Stroh
2005/0098156 A1 5/2005 Ohtani
2005/0131618 A1 6/2005 Megli et al.
2005/0197761 A1 9/2005 Bidner et al.
2005/0199220 A1* 9/2005 Ogiso ..... F02D 13/06 123/481
2005/0204726 A1 9/2005 Lewis
2005/0204727 A1 9/2005 Lewis et al.
2005/0205028 A1 9/2005 Lewis et al.
2005/0205045 A1 9/2005 Michelini et al.
2005/0205060 A1 9/2005 Michelini et al.
2005/0205063 A1 9/2005 Kolmanovsky et al.
2005/0205069 A1 9/2005 Lewis et al.
2005/0205074 A1 9/2005 Gibson et al.
2005/0235743 A1 10/2005 Stempnik et al.
2006/0107919 A1 5/2006 Nishi et al.
2006/0112918 A1 6/2006 Persson
2006/0130814 A1 6/2006 Bolander et al.
2006/0178802 A1 8/2006 Bolander et al.
2007/0012040 A1 1/2007 Nitzke et al.
2007/0042861 A1 2/2007 Takaoka et al.
2007/0100534 A1 5/2007 Katsumata
2007/0101969 A1 5/2007 Lay et al.
2007/0107692 A1 5/2007 Kuo et al.
2007/0131169 A1 6/2007 Ahn
2007/0131196 A1 6/2007 Gibson et al.
2007/0135988 A1 6/2007 Kidston et al.
2007/0235005 A1 10/2007 Lewis
2008/0000149 A1 1/2008 Aradi
2008/0041327 A1 2/2008 Lewis et al.
2008/0066699 A1 3/2008 Michelini et al.
2008/0098969 A1 5/2008 Reed et al.
2008/0121211 A1 5/2008 Livshiz et al.
2008/0154468 A1 6/2008 Berger et al.
2008/0254926 A1 10/2008 Schuseil et al.
2008/0262698 A1 10/2008 Lahti et al.
2008/0288146 A1 11/2008 Beechie et al.
2009/0007877 A1 1/2009 Raiford
2009/0013667 A1 1/2009 Winstead
2009/0013668 A1 1/2009 Winstead
2009/0013669 A1 1/2009 Winstead
2009/0013969 A1 1/2009 Winstead
2009/0018746 A1 1/2009 Miller et al.
2009/0030594 A1 1/2009 You et al.
2009/0042458 A1* 2/2009 Kinoshita ..... B63B 35/731 440/1
2009/0118914 A1 5/2009 Schwenke et al.
2009/0118968 A1 5/2009 Livshiz et al.
2009/0118975 A1* 5/2009 Murakami et al. ..... 701/103
2009/0118986 A1 5/2009 Kite
2009/0177371 A1 7/2009 Reinke
2009/0204312 A1 8/2009 Moriya
2009/0241872 A1 10/2009 Wang et al.
2009/0248277 A1 10/2009 Shinagawa et al.
2009/0248278 A1 10/2009 Nakasaka
2009/0292435 A1 11/2009 Costin et al.
2010/0006065 A1 1/2010 Tripathi et al.
2010/0010724 A1 1/2010 Tripathi et al.
2010/0012072 A1 1/2010 Leone et al.
2010/0030447 A1 2/2010 Smyth et al.
2010/0036571 A1 2/2010 Han et al.
2010/0042308 A1 2/2010 Kobayashi et al.
2010/0050993 A1 3/2010 Zhao et al.
2010/0059004 A1 3/2010 Gill
2010/0100299 A1 4/2010 Tripathi et al.
2010/0107630 A1 5/2010 Hamama et al.
2010/0192925 A1 8/2010 Sadakane
2010/0211299 A1 8/2010 Lewis et al.
2010/0222989 A1 9/2010 Nishimura
2010/0282202 A1 11/2010 Luken
2010/0318275 A1 12/2010 Borchsenius et al.
2011/0005496 A1 1/2011 Hiraya et al.
2011/0030657 A1 2/2011 Tripathi et al.
2011/0048372 A1* 3/2011 Dibble et al. ..... 123/350
2011/0088661 A1 4/2011 Sczomak et al.
2011/0094475 A1 4/2011 Riegel et al.
2011/0107986 A1* 5/2011 Winstead ..... F02D 13/0207 123/90.15
2011/0144883 A1 6/2011 Rollinger et al.
2011/0178693 A1 7/2011 Chang et al.
2011/0208405 A1 8/2011 Tripathi et al.
2011/0213540 A1 9/2011 Tripathi et al.
2011/0213541 A1 9/2011 Tripathi et al.
2011/0251773 A1 10/2011 Sahandiesfanjani et al.
2011/0264342 A1 10/2011 Baur et al.
2011/0265454 A1 11/2011 Smith et al.
2011/0265771 A1 11/2011 Banker et al.
2011/0295483 A1 12/2011 Ma et al.
2011/0313643 A1 12/2011 Lucatello et al.
2012/0029787 A1 2/2012 Whitney et al.
2012/0055444 A1 3/2012 Tobergte et al.
2012/0103312 A1 5/2012 Sasai et al.
2012/0109495 A1 5/2012 Tripathi et al.
2012/0116647 A1 5/2012 Pochner et al.
2012/0143471 A1 6/2012 Tripathi et al.
2012/0180759 A1 7/2012 Whitney et al.
2012/0221217 A1 8/2012 Sujan et al.
2012/0285161 A1 11/2012 Kerns et al.
2013/0092127 A1 4/2013 Pirjaberi et al.
2013/0092128 A1 4/2013 Pirjaberi et al.
2013/0184949 A1 7/2013 Saito et al.
2013/0289853 A1 10/2013 Serrano
2014/0041625 A1 2/2014 Pirjaberi et al.
2014/0041641 A1 2/2014 Carlson et al.
2014/0053802 A1 2/2014 Rayl
2014/0053803 A1 2/2014 Rayl
2014/0053804 A1 2/2014 Rayl et al.
2014/0053805 A1 2/2014 Brennan et al.
2014/0069178 A1 3/2014 Beikmann
2014/0069374 A1 3/2014 Matthews
2014/0069375 A1 3/2014 Matthews et al.
2014/0069376 A1 3/2014 Matthews et al.
2014/0069377 A1 3/2014 Brennan et al.
2014/0069378 A1 3/2014 Burleigh et al.
2014/0069379 A1 3/2014 Beikmann
2014/0069381 A1 3/2014 Beikmann
2014/0090623 A1 4/2014 Beikmann
2014/0090624 A1 4/2014 Verner
2014/0102411 A1 4/2014 Brennan
2014/0190448 A1 7/2014 Brennan et al.
2014/0190449 A1 7/2014 Phillips
2014/0194247 A1 7/2014 Burtch
2014/0207359 A1 7/2014 Phillips
2015/0240671 A1 8/2015 Nakamura
2015/0260112 A1 9/2015 Liu et al.
2015/0260117 A1 9/2015 Shost et al.
2015/0354470 A1 12/2015 Li et al.
2015/0361907 A1 12/2015 Hayman et al.

FOREIGN PATENT DOCUMENTS

CN 101220780 A 7/2008
CN 101353992 A 1/2009
CN 101476507 A 7/2009
CN 101586504 A 11/2009
CN 102454493 A 5/2012
EP 1489595 A2 12/2004

(56) References Cited

FOREIGN PATENT DOCUMENTS

| | | |
|---|---|---|
| JP | 2010223019 A | 10/2010 |
| JP | 2011149352 A | 8/2011 |

OTHER PUBLICATIONS

U.S. Appl. No. 13/798,384, filed Mar. 13, 2013, Burtch.
U.S. Appl. No. 13/798,518, filed Mar. 13, 2013, Beikmann.
U.S. Appl. No. 13/799,116, filed Mar. 13, 2013, Brennan.
U.S. Appl. No. 13/798,701, filed Mar. 13, 2013, Burleign et al.
U.S. Appl. No. 13/798,129, filed Mar. 13, 2013, Beikmann.
U.S. Appl. No. 14/734,619, filed Jun. 9, 2015, Matthews.
International Search Report and Written Opinion dated Jun. 17, 2015 corresponding to International Application No. PCT/US2015/019496, 14 pages.
U.S. Appl. No. 13/798,400, filed Mar. 13, 2013, Phillips.
U.S. Appl. No. 13/798,540, filed Mar. 13, 2013, Brennan et al.
U.S. Appl. No. 13/798,574, filed Mar. 13, 2013, Verner.
U.S. Appl. No. 13/798,624, filed Mar. 13, 2013, Brennan et al.
U.S. Appl. No. 13/798,775, filed Mar. 13, 2013, Phillips.
U.S. Appl. No. 13/799,129, filed Mar. 13, 2013, Beikmann.
U.S. Appl. No. 13/799,181, filed Mar. 13, 2013, Beikmann.
U.S. Appl. No. 14/143,267, filed Dec. 30, 2013, Gehringer et al.
U.S. Appl. No. 14/211,389, filed Mar. 14, 2014, Liu et al.
U.S. Appl. No. 14/300,469, filed Jun. 10, 2014, Li et al.
U.S. Appl. No. 14/310,063, filed Jun. 20, 2014, Wagh et al.
U.S. Appl. No. 14/449,726, filed Aug. 1, 2014, Hayman et al.
U.S. Appl. No. 14/734,619, filed Mar. 4, 2015, Shost et al.
U.S. Appl. No. 13/798,451, filed Mar. 13, 2013, Rayl.
U.S. Appl. No. 13/798,586, filed Mar. 13, 2013, Rayl et al.
U.S. Appl. No. 13/798,590, filed Mar. 13, 2013, Brennan et al.
U.S. Appl. No. 13/798,536, filed Mar. 13, 2013, Matthews et al.
U.S. Appl. No. 13/798,435, filed Mar. 13, 2013, Matthews.
U.S. Appl. No. 13/798,471, filed Mar. 13, 2013, Matthews et al.
U.S. Appl. No. 13/798,737, filed Mar. 13, 2013, Beikmann.
U.S. Appl. No. 13/798,701, filed Mar. 13, 2013, Burleigh et al.
U.S. Appl. No. 14/548,501, filed Nov. 20, 2014, Beikmann et al.
U.S. Appl. No. 61/952,737, filed Mar. 13, 2014, Shost et al.
U.S. Appl. No. 13/798,518, Beikmann, filed Mar. 13, 2013.
U.S. Appl. No. 13/799,129, Beikmann, filed Mar. 13, 2013.
U.S. Appl. No. 13/798,540, Brennan et al., filed Mar. 13, 2013.
U.S. Appl. No. 13/798,574, Verner, filed Mar. 13, 2013.
U.S. Appl. No. 13/799,181, Beikmann, filed Mar. 13, 2013.
U.S. Appl. No. 13/799,116, Brennan, filed Mar. 13, 2013.
U.S. Appl. No. 13/798,624, Brennan et al., filed Mar. 13, 2013.
U.S. Appl. No. 13/798,384, Burtch, filed Mar. 13, 2013.
U.S. Appl. No. 13/798,775, Phillips, filed Mar. 13, 2013.
U.S. Appl. No. 13/798,400, Phillips, filed Mar. 13, 2013.

* cited by examiner

CYLINDER DEACTIVATION PATTERN MATCHING

CROSS-REFERENCE TO RELATED APPLICATIONS

This application claims the benefit of U.S. Provisional Application No. 61/693,005, filed on Aug. 24, 2012. The disclosure of the above application is incorporated herein by reference in its entirety.

Ser. No. 13/798,451 filed on Mar. 13, 2013, Ser. No. 13/798,586 filed on Mar. 13, 2013, Ser. No. 13/798,590 filed on Mar. 13, 2013, Ser. No. 13/798,536 filed on Mar. 13, 2013, Ser. No. 13/798,435 filed on Mar. 13, 2013, Ser. No. 13/798,471 filed on Mar. 13, 2013 , Ser. No. 13/798,737 filed on Mar. 3, 2013, Ser. No. 13/798,701 filed on Mar. 13, 2013, Ser. No. 13/78,518 filed on Mar. 13, 2013 , Ser. No. 13/799,129 filed on Mar. 13, 2013, Ser. No. 13/798,540 filed on Mar. 13, 2013, Ser. No. 13/798,574 filed on Mar. 13, 2013, Ser. No. 13/799,181 filed on Mar. 13, 2013, Ser. No. 13/799,116 filed on Mar. 13, 2013, Ser. No. 13/798,624 filed on Mar. 13, 2013, Ser. No. 13/798,384 filed on Mar. 13, 2013, Ser. No. 13/798,755 filed on Mar. 13, 2013, and Ser. No. 13/798,400 filed on Mar. 13, 2013. The entire disclosures of the above application are incorporated herein by reference.

FIELD

The present disclosure relates to internal combustion engines and more specifically to cylinder deactivation control systems and methods.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

Under some circumstances, one or more cylinders of an engine may be deactivated. Deactivation of a cylinder may include deactivating the opening and closing of intake valves of the cylinder and halting the fueling of the cylinder. One or more cylinders may be deactivated, for example, to decrease fuel consumption when the engine can produce a requested amount of torque while the one or more cylinders are deactivated.

SUMMARY

A cylinder control module: selects one of N predetermined cylinder activation/deactivation patterns as a desired cylinder activation/deactivation pattern for cylinders of an engine, wherein N is an integer greater than two; activates opening of intake and exhaust valves of first ones of the cylinders that are to be activated based on the desired cylinder activation/deactivation pattern; and deactivates opening of intake and exhaust valves of second ones of the cylinders that are to be deactivated based on the desired cylinder activation/deactivation pattern. A fuel control module provides fuel to the first ones of the cylinders and disables fueling to the second ones of the cylinders. The cylinder control module further: determines M possible ones of the N cylinder activation/deactivation patterns, wherein M is an integer greater than or equal to one; selectively compares the M possible cylinder activation/deactivation patterns with the desired cylinder activation/deactivation pattern, and selectively updates the desired cylinder activation/deactivation pattern to one of the M possible cylinder activation/deactivation patterns.

A cylinder control method includes: selecting one of N predetermined cylinder activation/deactivation patterns as a desired cylinder activation/deactivation pattern for cylinders of an engine, wherein N is an integer greater than two; activating opening of intake and exhaust valves of first ones of the cylinders that are to be activated based on the desired cylinder activation/deactivation pattern; and deactivating opening of intake and exhaust valves of second ones of the cylinders that are to be deactivated based on the desired cylinder activation/deactivation pattern. The cylinder control method further includes: providing fuel to the first ones of the cylinders; disabling fueling to the second ones of the cylinders; and determining M possible ones of the N cylinder activation/deactivation patterns, wherein M is an integer greater than or equal to one. The cylinder control method further includes: selectively comparing the M possible cylinder activation/deactivation patterns with the desired cylinder activation/deactivation pattern; and selectively updating the desired cylinder activation/deactivation pattern to one of the M possible cylinder activation/deactivation patterns.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

One or more cylinders of an engine of a vehicle may be deactivated and/or operated according to a selected deactivation pattern (i.e., sequence). For example, the engine includes a plurality of possible deactivation patterns, and the vehicle determines which of the deactivation patterns to implement and selects a deactivation pattern accordingly.

The cylinders of the engine are selectively operated (i.e., fired or not fired) through one or more engine cycles based on the deactivation pattern. For example only, a control module of the vehicle determines the selected deactivation pattern based on a variety of factors including, but not limited to, respective fuel economies associated with each of the deactivation patterns and/or noise and vibration (N&V) associated each of the deactivation patterns. Fuel efficiency and N&V are, at least in part, based on the sequence in which cylinders are activated and deactivated (i.e., the deactivation pattern). In a cylinder deactivation pattern matching system according to the principles of the present disclosure, the control module controls transitions between two or more of the deactivation patterns based on comparisons between a previously selected (i.e., current) deactivation pattern and a plurality of possible next deactivation patterns.

Figure 1:
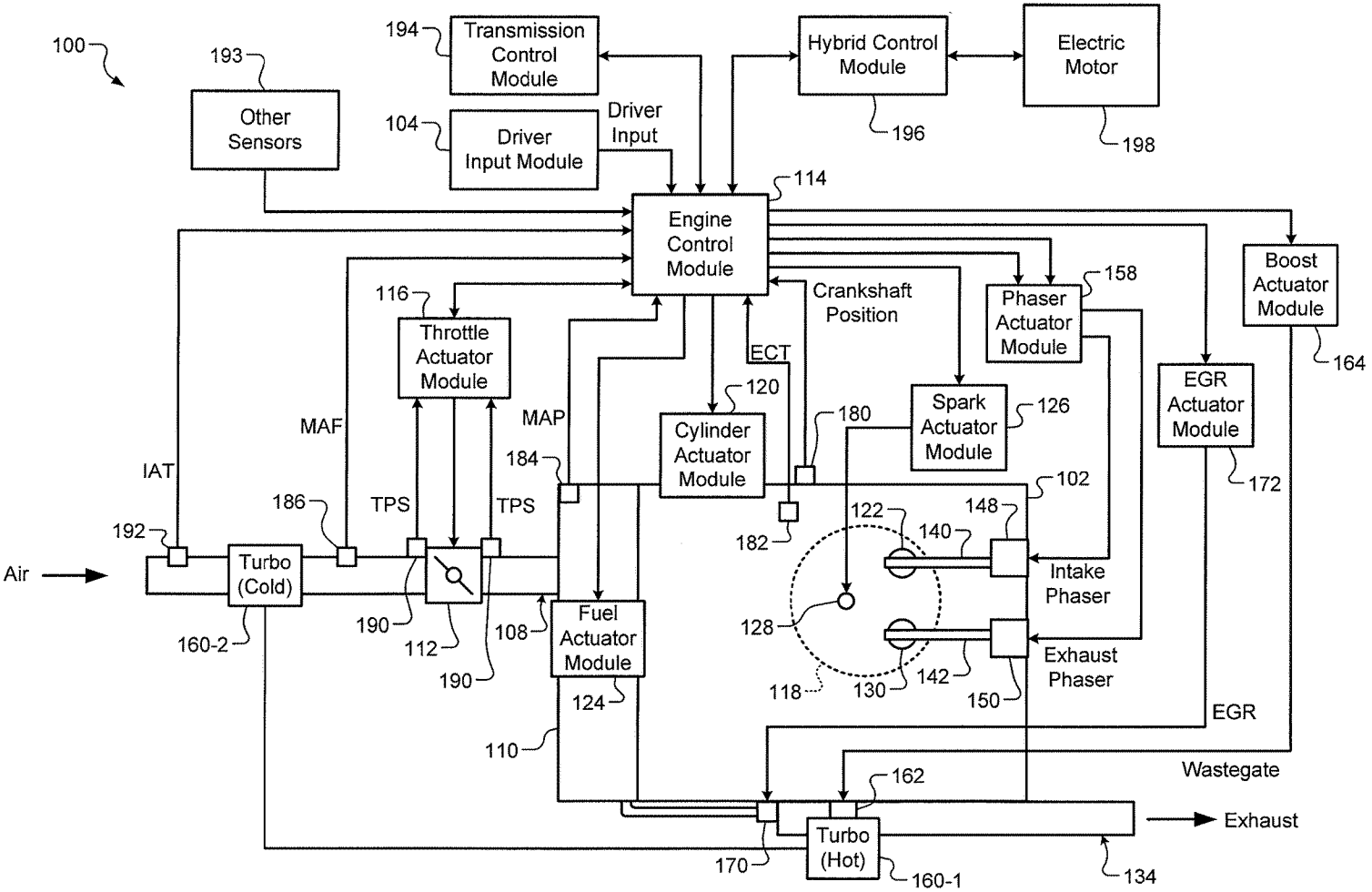
FIG. 1 is a functional block diagram of an example engine system according to the present disclosure.

Referring now to FIG. 1, a functional block diagram of an example engine system 100 is presented. The engine system 100 of a vehicle includes an engine 102 that combusts an air/fuel mixture to produce torque based on driver input from a driver input module 104. Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, as discussed further below, which may improve fuel efficiency.

The engine 102 may operate using a four-stroke cycle. The four strokes, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may halt provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time at which the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The cylinder actuator module 120 may deactivate the cylinder 118 by deactivating opening of the intake valve 122 and/or the exhaust valve 130. The time at which the intake valve 122 is opened may be varied with respect to piston TDC by an intake cam phaser 148. The time at which the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158. In various other implementations, the intake valve 122 and/or the exhaust valve 130 may be controlled by actuators other than camshafts, such as electromechanical actuators, electrohydraulic actuators, electromagnetic actuators, etc.

The engine system 100 may include a boost device that provides pressurized air to the intake manifold 110. For example, FIG. 1 shows a turbocharger including a turbine 160-1 that is driven by exhaust gases flowing through the exhaust system 134. The turbocharger also includes a compressor 160-2 that is driven by the turbine 160-1 and that compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) of the turbocharger. The ECM 114 may control the turbocharger via a boost actuator module 164. The boost actuator module 164 may modulate the boost of the turbocharger by controlling the position of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. Although shown separated for purposes of illustration, the turbine 160-1 and the compressor 160-2 may be mechanically linked to each other, placing intake air in close proximity to hot exhaust. The compressed air charge may absorb heat from components of the exhaust system 134.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

Crankshaft position may be measured using a crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. The engine system 100 may also include one or more other sensors 193. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The engine 102 outputs torque to a transmission (not shown) via the crankshaft. One or more coupling devices, such as a torque converter and/or one or more clutches, regulate torque transfer between a transmission input shaft and the crankshaft. Torque is transferred between the transmission input shaft and a transmission output shaft via the gears.

Torque is transferred between the transmission output shaft and wheels of the vehicle via one or more differentials, driveshafts, etc. Wheels that receive torque output by the transmission will be referred to as drive wheels. Wheels that do not receive torque from the transmission will be referred to as undriven wheels.

The ECM 114 may communicate with a hybrid control module 196 to coordinate operation of the engine 102 and one or more electric motors 198. The electric motor 198 may also function as a generator, and may be used to produce electrical energy for use by vehicle electrical systems and/or for storage in a battery. In various implementations, various functions of the ECM 114, the transmission control module 194, and the hybrid control module 196 may be integrated into one or more modules.

Each system that varies an engine parameter may be referred to as an engine actuator. Each engine actuator receives an actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the phaser actuator module 158, the boost actuator module 164, and the EGR actuator module 172. For these engine actuators, the actuator values may correspond to a cylinder activation/deactivation pattern, fueling rate, intake and exhaust cam phaser angles, boost pressure, and EGR valve opening area, respectively. The ECM 114 may generate the actuator values in order to cause the engine 102 to generate a desired engine output torque.

The ECM 114 and/or one or more other modules of the engine system 100 may implement the cylinder deactivation pattern matching system of the present disclosure. For example, the ECM 114 selects a next cylinder deactivation pattern based on one or more factors, including, but not limited to, engine speed, requested torque, a selected gear, air per cylinder (APC, e.g., an estimate or calculation of the mass of air in each cylinder), residual exhaust per cylinder (RPC, e.g., a mass of residual exhaust gas in each cylinder), and respective cylinder identifications (IDs). In particular, the ECM 114 determines one or more possible candidate cylinder deactivation patterns based on the above listed factors, and compares each of the possible cylinder deactivation patterns to a current cylinder deactivation pattern. The ECM 114 selects the next cylinder deactivation pattern based on the comparisons.

Figure 2:
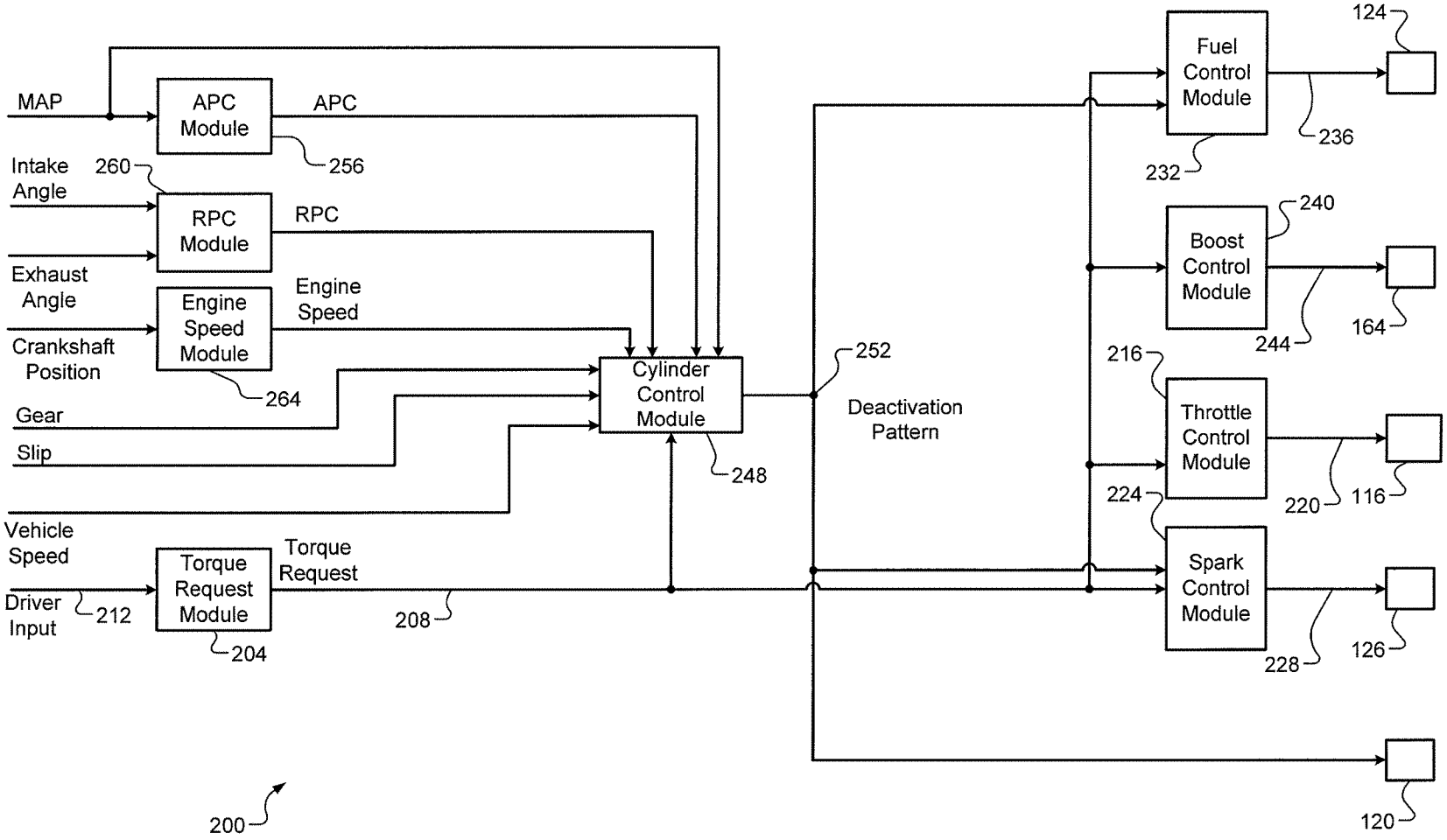
FIG. 2 is a functional block diagram of an engine control module according to the present disclosure.

Referring now to FIG. 2, a functional block diagram of an example engine control module (ECM) 200 is presented. A torque request module 204 may determine a torque request 208 based on one or more driver inputs 212, such as an accelerator pedal position, a brake pedal position, a cruise control input, and/or one or more other suitable driver inputs. The torque request module 204 may determine the torque request 208 additionally or alternatively based on one or more other torque requests, such as torque requests generated by the ECM 200 and/or torque requests received from other modules of the vehicle, such as the transmission control module 194, the hybrid control module 196, a chassis control module, etc.

One or more engine actuators may be controlled based on the torque request 208 and/or one or more other torque requests. For example, a throttle control module 216 may determine a desired throttle opening 220 based on the torque request 208. The throttle actuator module 116 may adjust opening of the throttle valve 112 based on the desired throttle opening 220. A spark control module 224 may determine a desired spark timing 228 based on the torque request 208. The spark actuator module 126 may generate spark based on the desired spark timing 228. A fuel control module 232 may determine one or more desired fueling parameters 236 based on the torque request 208. For example, the desired fueling parameters 236 may include fuel injection amount, number of fuel injections for injecting the amount, and timing for each of the injections. The fuel actuator module 124 may inject fuel based on the desired fueling parameters 236. A boost control module 240 may determine a desired boost 244 based on the torque request 208. The boost actuator module 164 may control boost output by the boost device(s) based on the desired boost 244.

Additionally, a cylinder control module 248 selects a desired cylinder activation/deactivation pattern 252 based on the torque request 208. The cylinder actuator module 120 deactivates the intake and exhaust valves of the cylinders that are to be deactivated according to the desired cylinder activation/deactivation pattern 252 and activates the intake and exhaust valves of cylinders that are to be activated according to the desired cylinder activation/deactivation pattern 252.

The cylinder control module 248 may select the desired cylinder activation/deactivation pattern 252 also based in part on, for example only, the APC, the RPC, the engine speed, the selected gear, slip, and/or vehicle speed. For example, an APC module 256 determines the APC based on MAP, MAF, throttle, and/or engine speed, an RPC module 260 determines the RPC based on an intake angle and an exhaust angle, EGR valve position, MAP, and/or engine speed, and an engine speed module 264 determines the engine speed based on a crankshaft position.

Fueling is halted (zero fueling) to cylinders that are to be deactivated according to the desired cylinder activation/deactivation pattern 252 and fuel is provided the cylinders that are to be activated according to the desired cylinder activation/deactivation pattern 252. Spark is provided to the cylinders that are to be activated according to the desired cylinder activation/deactivation pattern 252. Spark may be provided or halted to cylinders that are to be deactivated according to the desired cylinder activation/deactivation pattern 252. Cylinder deactivation is different than fuel cutoff (e.g., deceleration fuel cutoff) in that the intake and exhaust valves of cylinders to which fueling is halted during fuel cutoff are still opened and closed during the fuel cutoff.

Figure 3:
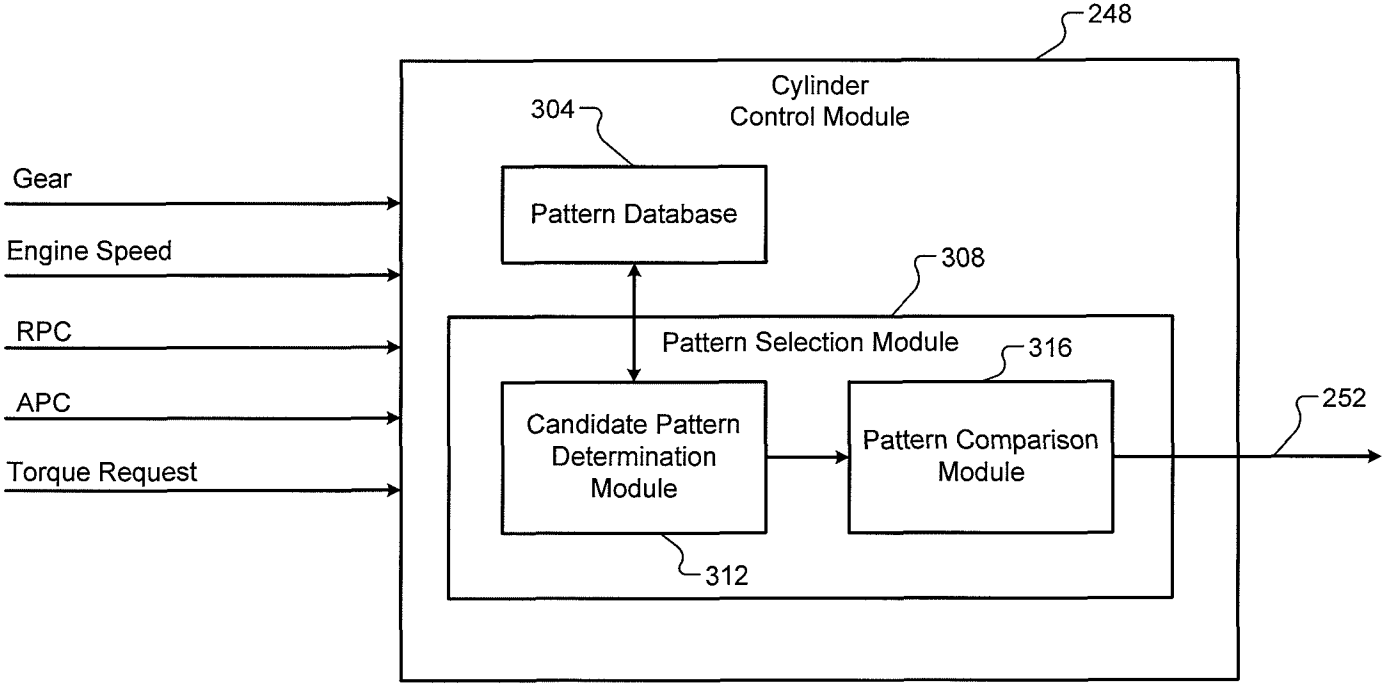
FIG. 3 is a functional block diagram of a cylinder control module according to the present disclosure.

Referring now to FIG. 3, an example implementation of the cylinder control module 248 is shown. Referring now to FIGS. 2 and 3, N (number of) predetermined cylinder deactivation patterns are stored, such as in a pattern database 304. N is an integer greater than 2 and may be, for example, 3, 4, 5, 6, 7, 8, 9, 10, or another suitable value.

Each of the N predetermined deactivation patterns includes an indicator for each of the next M events of a predetermined firing order of the cylinders. M is an integer that may less than, equal to, or greater than the total number of cylinders of the engine 102. For example only, M may be 20, 40, 60, 80, a multiple of the total number of cylinders of the engine, or another suitable number. M may be calibratable and set based on, for example, the engine speed, the torque request, and/or the total number of cylinders of the engine 102.

Each of the M indicators indicates whether the corresponding cylinder in the predetermined firing order should be activated or deactivated. For example only, the N predetermined deactivation patterns may each include an array including M (number of) zeros and/or ones. A zero may indicate that the corresponding cylinder should be activated, and a one may indicate that the corresponding cylinder should be deactivated, or vice versa.

The following deactivation patterns are provided as examples of predetermined deactivation patterns:

(1) [0 1 0 1 0 1 . . . 0 1]
(2) [0 0 1 0 0 1 . . . 0 0 1]
(3) [0 0 0 1 0 0 0 1 . . . 0 0 0 1]
(4) [0 0 0 0 0 0 . . . 0 0]
(5) [1 1 1 1 1 1 . . . 1 1]
(6) [0 1 1 0 1 1 . . . 0 1 1]
(7) [0 0 1 1 0 0 1 1 . . . 0 0 1 1]
(8) [0 1 1 1 0 1 1 1 . . . 0 1 1 1]

Pattern (1) corresponds to a repeating pattern of one cylinder in the predetermined firing order being activated, the next cylinder in the predetermined firing order being deactivated, the next cylinder in the predetermined firing order being activated, and so on. Pattern (2) corresponds to a repeating pattern of two consecutive cylinders in the predetermined firing order being activated, the next cylinder in the predetermined firing order being deactivated, the next two consecutive cylinders in the predetermined firing order being activated, and so on. Pattern (3) corresponds to a repeating pattern of three consecutive cylinders in the predetermined firing order being activated, the next cylinder in the predetermined firing order being deactivated, the next three consecutive cylinders in the predetermined firing order being activated, and so on. Pattern (4) corresponds to all of the cylinders being activated, and Pattern (5) corresponds to all of the cylinders being deactivated. Pattern (6) corresponds to a repeating pattern of one cylinder in the predetermined firing order being activated, the next two consecutive cylinders in the predetermined firing order being deactivated, the next cylinder in the predetermined firing order being activated, and so on. Pattern (7) corresponds to a repeating pattern of two consecutive cylinders in the predetermined firing order being activated, the next two consecutive cylinders in the predetermined firing order being deactivated, the next two consecutive cylinders in the predetermined firing order being activated, and so on. Pattern (8) corresponds to a repeating pattern of one cylinder in the predetermined firing order being activated, the next three consecutive cylinders in the predetermined firing order being deactivated, the next cylinder in the predetermined firing order being activated, and so on.

While the 8 example deactivation patterns have been provided above, the N predetermined deactivation patterns may include numerous other deactivation patterns. Also, while repeating patterns have been provided as examples, one or more non-repeating deactivation patterns may be included. While the N predetermined deactivation patterns have been discussed as being stored in arrays, the N predetermined deactivation patterns may be stored in another suitable form.

A pattern selection module 308 selects one of the N predetermined deactivation patterns and sets the desired cylinder activation/deactivation pattern 252 to the selected one of the N predetermined deactivation patterns. The cylinders of the engine 102 are activated or deactivated according to the desired cylinder activation/deactivation pattern 252 in the predetermined firing order. The desired cylinder activation/deactivation pattern 252 is repeated until a different one of the N predetermined deactivation patterns is selected.

The pattern selection module 308 includes a candidate pattern determination module 312 and a pattern comparison module 316. The candidate pattern determination module 312 communicates with the pattern database 304 to determine a primary candidate pattern and at least one alternate candidate pattern based in part on the factors described in FIG. 2. For example, the candidate pattern determination module 312 selects the primary candidate pattern, a first alternate candidate pattern, and a second alternate candidate pattern from the N predetermined deactivation patterns. The candidate pattern determination module 312 may select the primary and alternate candidate patterns based on a ranking of the N predetermined deactivation patterns. For example only, the N predetermined deactivation patterns may be ranked as described in Provisional Patent Application No. 61/693,057, filed on Aug. 24, 2012, which is incorporated herein in its entirety.

The primary candidate pattern may correspond to a highest ranked (i.e., most desirable) deactivation pattern based on the APC, RPC, engine speed, torque request, etc. The second alternate candidate pattern and the third alternate candidate pattern may correspond to a second and third highest ranked deactivation patterns, respectively. The candidate pattern determination module 312 provides the primary and alternative candidate patterns to the pattern comparison module 316.

The pattern comparison module 316 compares each of the primary and alternative candidate patterns to the current deactivation pattern (i.e., the desired cylinder activation/deactivation pattern 252 that is currently being implemented). The pattern comparison module 316 selects one of the primary and alternative candidate patterns as the next deactivation pattern to be output as the desired cylinder activation/deactivation pattern 252 based on the comparison. For example only, the pattern comparison module 316 compares respective pattern lengths, cylinder firing patterns, and/or the last cylinder(s) fired in the patterns and selects the next deactivation pattern accordingly.

For example, the pattern comparison module 316 may attempt to compare a last portion of the desired cylinder activation/deactivation pattern 252 to respective first portions of each of the candidate patterns to determine which of the candidate patterns most closely resembles the desired cylinder activation/deactivation pattern 252, and select the next deactivation pattern accordingly. In this manner, transition between the (current) desired cylinder activation/deactivation pattern 252 and the next pattern to be used as the desired cylinder activation/deactivation pattern 252 is facilitated. For example only, a last cylinder (or the last 2, 3, 4, or more cylinders) fired in the desired cylinder activation/deactivation pattern 252 and a first cylinder (or the first 2, 3, 4, or more cylinders) fired in the next deactivation pattern may be given more weight in the comparison than remaining cylinders. In other words, a last P events in the desired cylinder activation/deactivation pattern 252 may be compared to the first P events of each of the primary and alternate candidate patterns. The pattern comparison module 316 selects the candidate pattern that has the greatest number of the first P events that match the last P events of the desired cylinder activation/deactivation pattern 252. The pattern comparison module 316 outputs the desired cylinder activation/deactivation pattern 252 according to the selected next deactivation pattern.

Alternatively, the pattern comparison module 316 may compare any sequence of P events of the desired cylinder activation/deactivation pattern 252 to any sequence of P events of each of the candidate patterns to determine the best match between any portion of the desired cylinder activation/deactivation pattern 252 and any portion of the candidate patterns. The pattern comparison module 316 then selects the candidate pattern having the greatest number of any sequence of P events that match any sequence of P events of the desired cylinder activation/deactivation pattern 252.

Figure 4:
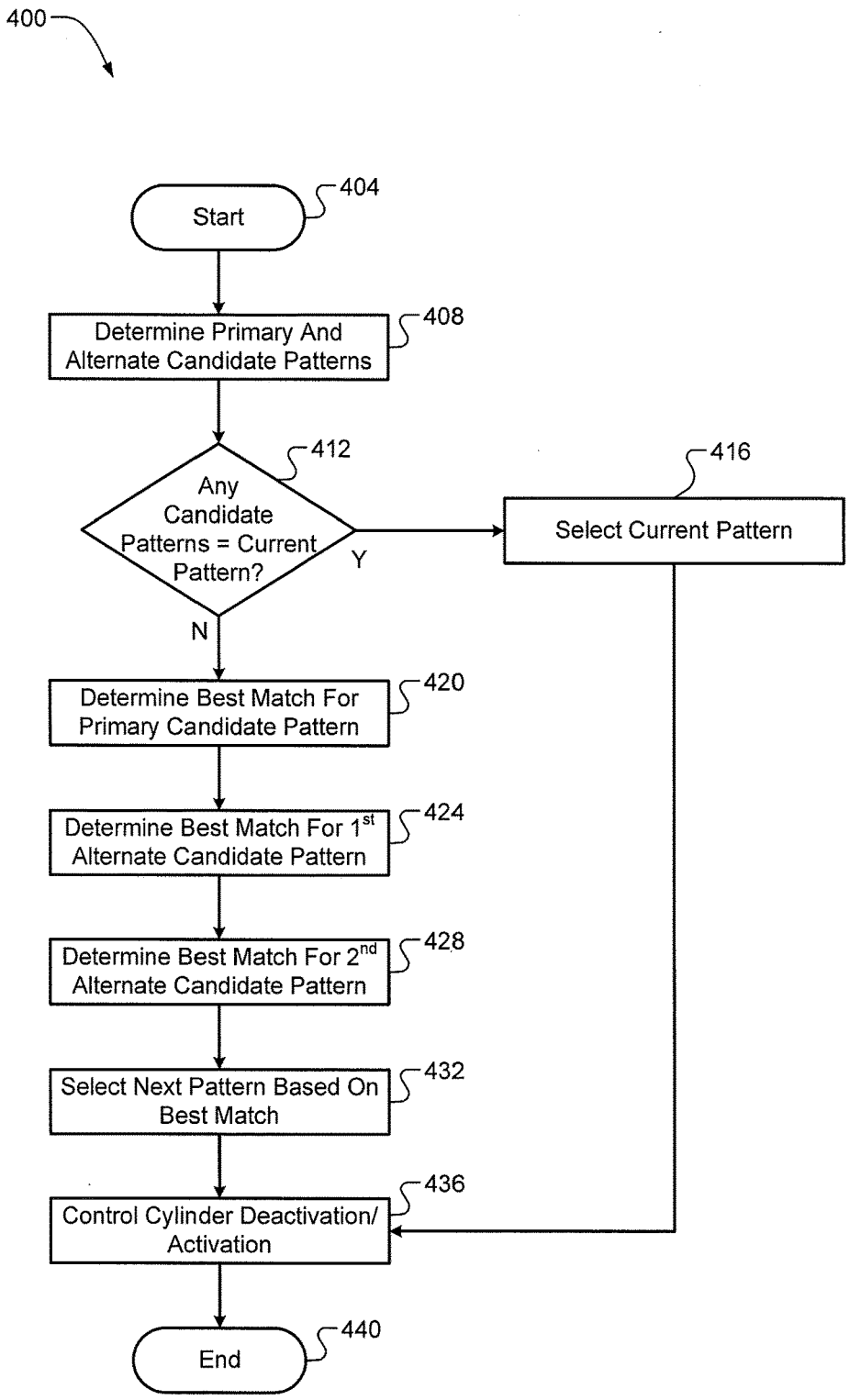
FIG. 4 illustrates a cylinder deactivation pattern matching method according to the present disclosure.

Referring now to FIG. 4, a cylinder deactivation pattern matching method 400 begins at 404. At 408, the method 400 determines a primary candidate deactivation pattern and first and second alternate candidate deactivation patterns. At 412, the method 400 determines whether any of the candidate deactivation patterns is the same as the current deactivation pattern. If true, the method 400 continues to 416. If false, the method 400 continues to 420. At 416, the method 400 selects and continues to use the current deactivation pattern, and the method 400 continues with 436.

At 420, the method 400 compares the current deactivation pattern to the primary candidate pattern to determine a best match (e.g., a greatest number of matches between any sequence of P events in the primary candidate pattern and any sequence of P events in the current deactivation pattern) between the primary candidate pattern and the current deactivation pattern. Or, the method 400 may simply determine a number of matched events in the first P events of the primary candidate pattern and the last P events in the current deactivation pattern. At 424, the method 400 compares the current deactivation pattern to the first alternate candidate pattern to determine a best match between the first alternate candidate pattern and the current deactivation pattern. At 428, the method 400 compares the current deactivation pattern to the second alternate candidate pattern to determine a best match between the second alternate candidate pattern and the current deactivation pattern. At 432, the method 400 selects the next deactivation pattern based on the candidate pattern having the best match with the current deactivation pattern. At 436, the method 400 controls cylinder deactivation/activation according to the selected next deactivation pattern. The method 400 ends at 440. While the method 400 is shown and discussed as ending, FIG. 4 may be illustrative of one control loop and control loops may be performed at a predetermined rate.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. For purposes of clarity, the same reference numbers will be used in the drawings to identify similar elements. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from multiple modules may be executed using a single (shared) processor. In addition, some or all code from multiple modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

What is claimed is:

1. A cylinder control system of a vehicle, comprising:

a cylinder control module that:

selects one of N predetermined cylinder activation/deactivation patterns as a desired cylinder activation/deactivation pattern for cylinders of an engine, wherein N is an integer greater than two, each of the N predetermined cylinder activation/deactivation patterns including P indicators for the next P cylinder events, each of the P indicators indicating whether to activate or deactivate a corresponding cylinder, and P is an integer greater than a total number of cylinders of the engine;

activates opening of intake and exhaust valves of first ones of the cylinders that are to be activated based on the desired cylinder activation/deactivation pattern; and deactivates opening of intake and exhaust valves of second ones of the cylinders that are to be deactivated based on the desired cylinder activation/deactivation pattern; and a fuel control module that provides fuel to the first ones of the cylinders and that disables fueling to the second ones of the cylinders, wherein the cylinder control module further:

determines M possible ones of the N cylinder activation/deactivation patterns, wherein M is an integer greater than or equal to one;

selectively compares portions of the M possible cylinder activation/deactivation patterns, respectively, with a portion of the desired cylinder activation/deactivation pattern; and selectively updates the desired cylinder activation/deactivation pattern to one of the M possible cylinder activation/deactivation patterns based on the comparisons.

2. The cylinder control system of claim 1 wherein the cylinder control module includes a pattern database that stores the N predetermined cylinder activation/deactivation patterns.

3. The cylinder control system of claim 1 wherein the portion of the desired cylinder activation/deactivation pattern corresponds to the last Q indicators for the last Q events of the desired cylinder activation/deactivation pattern, and wherein the portions of each of the M possible cylinder activation/deactivation patterns correspond to the first Q indicators of the first Q events of the M possible cylinder activation/deactivation patterns, wherein Q is an integer greater than one and less than or equal to P.

4. The cylinder control system of claim 1 wherein the cylinder control module determines the M possible cylinder activation/deactivation patterns based on engine speed.

5. The cylinder control system of claim 1 wherein the cylinder control module determines the M possible cylinder activation/deactivation patterns based on a requested torque output of the engine.

6. The cylinder control system of claim 1 wherein the cylinder control module determines the M possible cylinder activation/deactivation patterns based on a gear ratio of a transmission.

7. The cylinder control system of claim 1 wherein the cylinder control module determines the M possible cylinder activation/deactivation patterns based on an amount of air per cylinder.

8. The cylinder control system of claim 1 wherein the cylinder control module determines the M possible cylinder activation/deactivation patterns based on an amount of residual exhaust per cylinder.

9. The cylinder control system of claim 1 wherein the cylinder control module determines the M possible cylinder activation/deactivation patterns based on engine speed, a requested torque output of the engine, a gear ratio of a transmission, an amount of air per cylinder, and an amount of residual exhaust per cylinder.

10. A cylinder control method for a vehicle, the method comprising:

selecting one of N predetermined cylinder activation/deactivation patterns as a desired cylinder activation/deactivation pattern for cylinders of an engine, wherein N is an integer greater than two, each of the N predetermined cylinder activation/deactivation patterns including P indicators for the next P cylinder events, each of the P indicators indicating whether to activate or deactivate a corresponding one cylinder, and P is an integer greater than a total number of cylinders of the engine;

activating opening of intake and exhaust valves of first ones of the cylinders that are to be activated based on the desired cylinder activation/deactivation pattern;

deactivating opening of intake and exhaust valves of second ones of the cylinders that are to be deactivated based on the desired cylinder activation/deactivation pattern;

providing fuel to the first ones of the cylinders;

disabling fueling to the second ones of the cylinders;

determining M possible ones of the N cylinder activation/deactivation patterns, wherein M is an integer greater than or equal to one;

comparing portions of the M possible cylinder activation/deactivation patterns, respectively, with a portion of the desired cylinder activation/deactivation pattern; and selectively updating the desired cylinder activation/deactivation pattern to one of the M possible cylinder activation/deactivation patterns based on the comparisons.

11. The cylinder control method of claim 10 further comprising retrieving the N predetermined cylinder activation/deactivation patterns from a pattern database.

12. The cylinder control method of claim 10 wherein the portion of the desired cylinder activation/deactivation pattern corresponds to the last Q indicators for the last Q events of the desired cylinder activation/deactivation pattern, and wherein the portions of each of the M possible cylinder activation/deactivation patterns correspond to the first Q indicators of the first Q events of the M possible cylinder activation/deactivation patterns, wherein Q is an integer greater than one and less than or equal to P.

13. The cylinder control method of claim 10 further comprising determining the M possible cylinder activation/deactivation patterns based on engine speed.

14. The cylinder control method of claim 10 further comprising determining the M possible cylinder activation/deactivation patterns based on a requested torque output of the engine.

15. The cylinder control method of claim 10 further comprising determining the M possible cylinder activation/deactivation patterns based on a gear ratio of a transmission.

16. The cylinder control method of claim 10 further comprising determining the M possible cylinder activation/deactivation patterns based on an amount of air per cylinder.

17. The cylinder control method of claim 10 further comprising determining the M possible cylinder activation/deactivation patterns based on an amount of residual exhaust per cylinder.

18. The cylinder control method of claim 10 further comprising determining the M possible cylinder activation/deactivation patterns based on engine speed, a requested torque output of the engine, a gear ratio of a transmission, an amount of air per cylinder, and an amount of residual exhaust per cylinder.

* * * * *